US010119099B2

(12) United States Patent
Clemence et al.

(10) Patent No.: US 10,119,099 B2
(45) Date of Patent: Nov. 6, 2018

(54) PEROXIDE BASED MULTI-PURPOSE CLEANER, DEGREASER, SANITIZER/VIRUCIDE AND ASSOCIATED SOLUTIONS AND METHODS FOR PREPARING THE SAME

(71) Applicants: Josh Clemence, Covington, IN (US); Noah Durham, Champaign, IL (US)

(72) Inventors: Josh Clemence, Covington, IN (US); Noah Durham, Champaign, IL (US)

(73) Assignee: Envirox, L.L.C., Danville, IL (US)

( * ) Notice: Subject to any disclaimer, the term of this patent is extended or adjusted under 35 U.S.C. 154(b) by 135 days.

(21) Appl. No.: 15/402,622

(22) Filed: Jan. 10, 2017

(65) Prior Publication Data

US 2018/0195026 A1 Jul. 12, 2018

(51) Int. Cl.

| | |
|---|---|
| ***C11D 1/83*** | (2006.01) |
| ***C11D 3/43*** | (2006.01) |
| ***C11D 3/00*** | (2006.01) |
| ***C11D 3/20*** | (2006.01) |
| ***C11D 3/39*** | (2006.01) |
| *C11D 1/22* | (2006.01) |
| *C11D 1/72* | (2006.01) |

(52) U.S. Cl.

CPC ..... *C11D 1/83* (2013.01); *C11D 3/0084* (2013.01); *C11D 3/2093* (2013.01); *C11D 3/3947* (2013.01); *C11D 3/43* (2013.01); *C11D 1/22* (2013.01); *C11D 1/72* (2013.01)

(58) Field of Classification Search

CPC ..... C11D 1/83; C11D 3/43; C11D 3/0084; C11D 3/2093

See application file for complete search history.

(56) References Cited

U.S. PATENT DOCUMENTS

| | | | |
|---|---|---|---|
| 2,371,545 | A | 3/1945 | Riggs et al. |
| 2,886,532 | A | 5/1959 | Richmond et al. |
| 3,869,401 | A | 3/1975 | Ernst |
| 3,977,826 | A | 8/1976 | Iscowitz |
| 4,022,703 | A | 5/1977 | Bakes et al. |
| 4,130,501 | A | 12/1978 | Lutz et al. |
| 4,146,499 | A | 3/1979 | Rosano |
| 4,230,478 | A | 10/1980 | Zumbrunn |
| 4,362,706 | A | 12/1982 | Willard |
| 4,414,128 | A | 11/1983 | Goffinet |
| 4,430,236 | A | 2/1984 | Franks |
| 4,472,291 | A | 9/1984 | Rosano |
| 4,530,781 | A | 7/1985 | Gipp |
| 4,656,043 | A | 4/1987 | Hawkins et al. |
| 4,704,225 | A | 11/1987 | Stoufer |
| 4,711,739 | A | 12/1987 | Kandathil |
| 4,749,516 | A | 6/1988 | Brusky |
| 4,829,897 | A | 5/1989 | Wyman |
| 4,877,544 | A | 10/1989 | Gabriel et al. |
| 4,900,468 | A | 2/1990 | Mitchell et al. |
| 5,008,030 | A | 4/1991 | Cook |
| 5,102,575 | A | 4/1992 | Lanniel et al. |
| 5,130,124 | A | 7/1992 | Merianos et al. |
| 5,180,514 | A | 1/1993 | Farr et al. |
| 5,213,624 | A | 5/1993 | Williams |
| 5,281,280 | A | 1/1994 | Lisowski |
| 5,281,354 | A | 1/1994 | Faber |
| 5,336,426 | A | 8/1994 | Rader et al. |
| 5,368,867 | A | 11/1994 | DaSilva |
| 5,376,297 | A | 12/1994 | Choy |
| 5,380,457 | A | 1/1995 | Zielske |
| 5,389,157 | A | 2/1995 | Smith |
| 5,399,282 | A | 3/1995 | Hansen |
| 5,527,486 | A | 6/1996 | De Guertechin |
| 5,531,938 | A | 7/1996 | Erilli |
| 5,549,840 | A | 8/1996 | Mondin et al. |
| 5,585,034 | A | 12/1996 | Lysy et al. |
| 5,602,090 | A | 2/1997 | Melikyan et al. |
| 5,614,484 | A | 3/1997 | Panadiker |
| 5,653,970 | A | 8/1997 | Vermeer |
| 5,696,171 | A | 12/1997 | Rupp et al. |
| 6,316,399 | B1 | 11/2001 | Melikyan et al. |
| 6,495,501 | B1 * | 12/2002 | Del Duca ..... C11D 3/2075 510/283 |
| 6,939,839 | B2 | 9/2005 | Johnson |
| 7,439,218 | B2 | 10/2008 | Bowker |
| 7,879,787 | B2 | 2/2011 | Heintz et al. |

(Continued)

*Primary Examiner* — Charles I Boyer

(74) *Attorney, Agent, or Firm* — King & Partners, PLC

(57) ABSTRACT

A cleaning solution including: a primary solvent; a secondary solvent; an oxidizing agent, wherein the oxidizing agent includes a peroxide; a surfactant system, wherein the surfactant system includes a nonionic surfactant, a first anionic surfactant, and a second anionic surfactant; and an antioxidant, wherein the antioxidant is characterized by the structure of formula I:

(I)

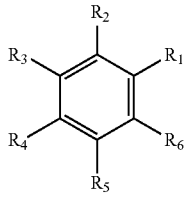

wherein $R_1$-$R_6$, are each independently selected from the group including H; OH; and an alkyl, cycloalkyl, polycycloalkyl, heterocycloalkyl, aryl, alkaryl, aralkyl, alkoxy, alkanoyl, aroyl, alkenyl, alkyl-alkenyl, alcohol, ether, ketone, carboxylic acid, acid halide, acid anhydride, ester, and/or amide group containing approximately 1 to approximately 25 carbon atom(s); wherein at least three of $R_1$-$R_6$ include OH; and wherein at least one of $R_1$-$R_6$ includes an ester.

2 Claims, No Drawings

(56) References Cited

U.S. PATENT DOCUMENTS

| | | | | |
|---|---|---|---|---|
| 8,375,494 | B2 | 2/2013 | Hammock | |
| 2006/0073994 | A1* | 4/2006 | Hage | C11D 3/38618 510/101 |
| 2006/0257281 | A1* | 11/2006 | Weide | A61K 31/00 422/6 |
| 2006/0281656 | A1* | 12/2006 | Ouwendijk-Vrijenhoek | C11D 3/0084 510/376 |
| 2007/0167342 | A1* | 7/2007 | Van Asten | C11D 3/0084 510/302 |
| 2012/0053107 | A1* | 3/2012 | Labeque | C11D 3/33 510/296 |
| 2012/0129755 | A1* | 5/2012 | Zhu | C11D 1/94 510/372 |
| 2018/0148672 | A1* | 5/2018 | Valenti | C09B 11/02 |

* cited by examiner

PEROXIDE BASED MULTI-PURPOSE CLEANER, DEGREASER, SANITIZER/VIRUCIDE AND ASSOCIATED SOLUTIONS AND METHODS FOR PREPARING THE SAME

CROSS-REFERENCE TO RELATED APPLICATIONS

Not Applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to multi-purpose cleaners, degreasers, sanitizers/virucides and associated solutions and, more particularly, to novel, peroxide based cleaning solutions that are: (1) effective; (2) exhibit environmentally preferred characteristics for industrial, commercial, and residential applications; and (3) satisfy color, odor, and shelf life expectations of the customer. The novel peroxide based cleaning solutions of the present invention are preferably suitable for use as both a sanitizer/virucide and a deodorizer for hard, non-porous surfaces, among other surfaces. The novel peroxide based cleaning solutions of the present invention are also preferably suitable for carpet extraction applications, namely for cleaning, deodorizing, and killing odor causing bacteria.

2. Background Art

Cleaning solutions and associated formulations have been known in the art for years and are the subject of a plurality of patents and/or publications, including: U.S. Pat. No. 8,375,494 entitled "Cleaning Compositions Containing A Corrosion Inhibitor," U.S. Pat. No. 7,879,787 entitled "Cleaning Compositions For Hard To Remove Organic Material," U.S. Pat. No. 7,439,218 entitled "Disinfectant Compositions Comprising An Orange Oil Mixture And Methods Of Use Thereof," U.S. Pat. No. 6,939,839 entitled "Cleaning Composition With Terpene And Hydrogen Peroxide," U.S. Pat. No. 5,653,970 entitled "Personal Product Compositions Comprising Heteroatom Containing Alkyl Aldonamide Compounds," U.S. Pat. No. 5,602,090 entitled "Surfactant Based Aqueous Compositions With D-Limonene And Hydrogen Peroxide And Methods Using The Same," U.S. Pat. No. 5,549,840 entitled "Cleaning Composition In Microemulsion, Liquid Crystal Or Aqueous Solution Form Comprising Mixture Of Partially Esterified, Full Esterified And Non-Esterified Ethoxylated Polyhydric Alcohols," U.S. Pat. No. 5,281,354 entitled "Liquid Cleanser Composition," U.S. Pat. No. 4,877,544 entitled "Oxidation Stable Surfactants," and U.S. Pat. No. 4,472,291 entitled "High Viscosity Microemulsions" all of which are hereby incorporated herein by reference in their entirety—including all references cited therein.

U.S. Pat. No. 8,375,494 appears to disclose cleaning compositions containing a corrosion inhibitor for removing soil from carpets, upholstery and the like without subjecting common metal alloys used in aircraft and other constructions to corrosive attack. The cleaning compositions include at least one dispersing agent, at least one anti-redeposition agent, at least one corrosion inhibitor, at least one pH modifier, at least one chelating agent and at least one stabilizing agent. The compositions also optionally include at least one fragrance and/or at least one preservative agent.

U.S. Pat. No. 7,879,787 appears to disclose an oxidizing cleaning composition that comprises a low concentration of aqueous hydrogen peroxide that is environmentally friendly and has stability in strong alkaline solutions. The aqueous hydrogen peroxide composition contains a combination of one or more hydrophilic surfactants having an HLB of 10 or greater, one or more hydrotropes, one or more UV-analyzable surfactants having an aromatic detectable functional group, and optionally a surfactant having an HLB of less than 10. The cleaning composition when mixed with an alkaline compound purports to be very effective in removing dried or baked residues of polymers, modified or natural celluloses starches, natural gels, and the like at low concentrations and temperatures.

U.S. Pat. No. 7,439,218 appears to disclose a disinfectant composition comprising hydrogen peroxide ($H_2O_2$), orange terpene oil, orange valencia oil, a non-ionic emulsifier, and distilled or deionized water ($H_2O$).

U.S. Pat. No. 6,939,839 appears to disclose a cleaning composition that uses a terpene such as D-limonene or orange oil, a nonionic surfactant, a single anionic surfactant, an anti-oxidant, hydrogen peroxide, and the balance deionized water.

U.S. Pat. No. 5,653,970 appears to disclose personal product compositions having heteroatom containing alkyl aldonamide compounds and a skin-conditioning agent. The '970 patent teaches that when these heteroatom containing alkyl aldonamides are used, benefits such as enhanced stability and/or enhanced viscosity are obtained relative to the use of other known thickeners or non-heteroatom containing aldonamides.

U.S. Pat. No. 5,602,090 appears to disclose a cleaning composition including a terpene such as D-limonene and hydrogen peroxide in a surfactant based aqueous solution. The composition in various specific formulations is a microemulsion useful for a variety of materials for both industrial and household applications.

U.S. Pat. No. 5,549,840 appears to disclose liquid crystal compositions or microemulsion compositions that are effective in the removal of oily and greasy soil and have evidenced grease release effect. Such compositions contain an anionic detergent, an ethoxylated glycerol type compound, a hydrocarbon ingredient, and water which comprises the use of a water-insoluble odoriferous perfume as the essential hydrocarbon ingredient in a proportion sufficient to form a dilute o/w microemulsion composition.

U.S. Pat. No. 5,281,354 appears to disclose a liquid cleanser composition, particularly for use as a hard surface cleanser that comprises a mixture of from about 0.5% to about 10% of a terpene selected from mono- and sesquiterpenes and mixtures thereof, from about 1% to about 10% of a water miscible solvent, and, from about 1% to about 10% of an amide surfactant. The '354 patent also discloses that the composition can contain from about 10% to about 70% of a water-insoluble abrasive.

U.S. Pat. No. 4,877,544 appears to disclose detergent compositions comprising a special type of oxidation resistant nonionic surfactant and an oxidizing agent which may either be a hypochlorite or a peroxygen material. The surfactant component structurally comprises a $C_8$-$C_{12}$ alkyl substituted phenoxy hydrophobe alkoxylated with ethylene oxide and/or propylene oxide, with the proviso that the ratio of ethylene oxide to propylene oxide is at least 1 but no higher than 10. Methyl or chloroethyl groups are used to endcap the surfactant.

U.S. Pat. No. 4,472,291 appears to disclose an oil-in-water microemulsion of increased viscosity. The microemulsion comprises an aqueous continuous phase, an oil phase, a primary surfactant having a lipophilic moiety and a hydrophilic moiety, wherein the hydrophilic moiety carries an electrostatic charge and a cosurfactant. The viscosity is increased by adding a secondary surfactant which is characterized by a long chain lipophilic moiety and a charged hydrophilic moiety which is reactive with the charged hydrophilic moiety of the primary surfactant. In forming the microemulsion of increased viscosity, the microemulsion is formed first in the absence of the secondary surfactant, and the secondary surfactant is added thereto.

While the cleaning solutions and formulations disclosed supra have been known in the art for years, issues associated with formulation color, odor, and extended shelf life while maintaining environmentally preferred characteristics remain largely problematic and/or unsolved. As such, there is a genuine demand for novel peroxide based cleaners, degreasers, and sanitizers/virucides and associated solutions that are effective, exhibit environmentally preferred characteristics for industrial, commercial, and residential applications, and satisfy color, odor, and shelf life expectations of the customer.

These and other objects of the present invention will become apparent in light of the present specification, claims, chemical structures, chemical formulae, and drawings.

SUMMARY OF THE INVENTION

The present invention is directed to a cleaning solution comprising, consisting essentially of, and/or consisting of: (a) a primary solvent; (b) a secondary solvent; (c) an oxidizing agent, wherein the oxidizing agent comprises a peroxide; (d) a surfactant system (preferably a hybrid and/or heterogeneous system), wherein the surfactant system preferably comprises (1) a nonionic surfactant, (2) a first anionic surfactant, and (3) a second anionic surfactant; and (e) an antioxidant, wherein the antioxidant comprises the structure of formula I:

(I)

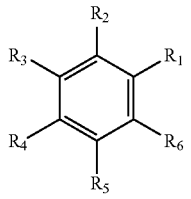

wherein $R_1$-$R_6$, are each independently selected from the group consisting of H; OH; and an alkyl, cycloalkyl, polycycloalkyl, heterocycloalkyl, aryl, alkaryl, aralkyl, alkoxy, alkanoyl, aroyl, alkenyl, alkyl-alkenyl, alcohol, ether, ketone, carboxylic acid, acid halide, acid anhydride, ester, and/or amide group containing approximately 1 to approximately 25 carbon atom(s); wherein at least three of $R_1$-$R_6$ comprise OH; and wherein at least one of $R_1$-$R_6$ comprises an ester.

In a preferred embodiment of the present invention, $R_2$-$R_4$ of the antioxidant comprising the structure of formula I each comprise OH, and $R_6$ comprises an ester group containing approximately 3 to approximately 7 carbon atoms.

In another preferred embodiment of the present invention, the antioxidant comprises the structure of formula II:

(II)

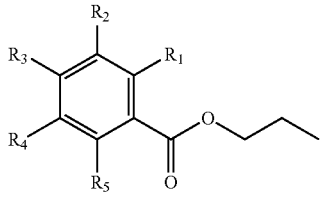

wherein three of $R_1$-$R_5$ comprise OH.

In yet another preferred embodiment of the present invention, the antioxidant comprises the structure of formula III:

(III)

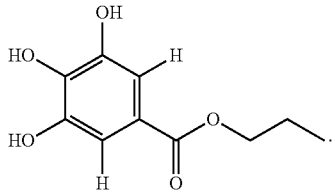

In a preferred embodiment of the present invention, the primary solvent comprises water.

In another preferred embodiment of the present invention, the secondary solvent is selected from the group consisting of a terpene, a cyclic terpene, orange oil, limonene, and d-limonene.

In yet another a preferred embodiment of the present invention, the peroxide is selected from the group consisting of an inorganic peroxide and an organic peroxide, and preferably comprises hydrogen peroxide.

In one aspect of the present invention, the nonionic surfactant of the hybrid surfactant system preferably comprises an ethoxylated alcohol.

In another aspect of the present invention, the nonionic surfactant of the hybrid surfactant system preferably comprises the structure of formula IV:

$$R_1O(CH_2CH_2O)_nH \quad \text{(IV)}$$

wherein $R_1$ comprises a hydrophobic portion of the nonionic surfactant obtained from a linear alcohol having carbon lengths ranging from approximately 12 to approximately 15; and wherein n comprises an integer ranging from approximately 7 to approximately 10, and wherein n represents the average moles of ethylene oxide per mole of alcohol.

In one embodiment of the present invention, the first anionic surfactant of the surfactant system comprises a sulfonate, including, but not limited to, an alkyl benzene sulfonate.

In a preferred embodiment of the present invention, the first anionic surfactant of the hybrid surfactant system comprises the structure of formula V:

(V)

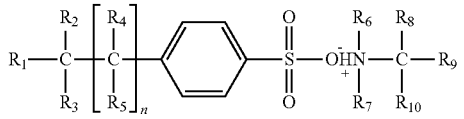

wherein $R_1$-$R_{10}$, are each independently selected from the group consisting of H; OH; and an alkyl, cycloalkyl, polycycloalkyl, heterocycloalkyl, aryl, alkaryl, aralkyl, alkoxy, alkanoyl, aroyl, alkenyl, alkyl-alkenyl, alcohol, ether, ketone, carboxylic acid, acid halide, acid anhydride, ester, and/or amide group containing approximately 1 to approximately 25 carbon atom(s); and wherein n comprises an integer ranging from approximately 5 to approximately 15.

In another preferred embodiment of the present invention, the first anionic surfactant of the hybrid surfactant system comprises the structure of formula VI:

(VI)

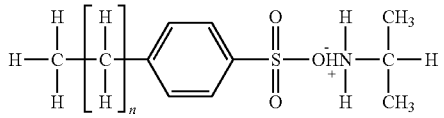

wherein n comprises an integer ranging from approximately 5 to approximately 15.

In yet another preferred embodiment of the present invention, the first anionic surfactant of the hybrid surfactant system comprises the structure of formula VII:

(VII)

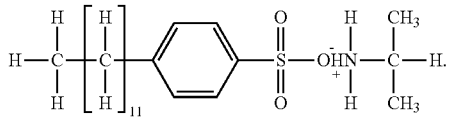

In one embodiment of the present invention, the second anionic surfactant of the hybrid surfactant system comprises a sulfonate, including, but not limited to, an alkyl sulfonate.

In a preferred embodiment of the present invention, the second anionic surfactant of the hybrid surfactant system comprises the structure of formula VIII:

(VIII)

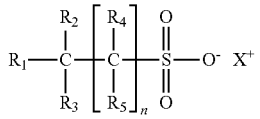

wherein $R_1$-$R_5$, are each independently selected from the group consisting of H; OH; and an alkyl, cycloalkyl, polycycloalkyl, heterocycloalkyl, aryl, alkaryl, aralkyl, alkoxy, alkanoyl, aroyl, alkenyl, alkyl-alkenyl, alcohol, ether, ketone, carboxylic acid, acid halide, acid anhydride, ester, and/or amide group containing approximately 1 to approximately 25 carbon atom(s); wherein n comprises an integer ranging from approximately 2 to approximately 15; and wherein X comprises an alkali metal ion.

In another preferred embodiment of the present invention, the second anionic surfactant of the hybrid surfactant system comprises the structure of formula IX:

(IX)

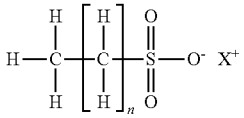

wherein n comprises an integer ranging from approximately 2 to approximately 15; and wherein X comprises an alkali metal ion.

In yet another preferred embodiment of the present invention, the second anionic surfactant of the hybrid surfactant system comprises the structure of formula X:

(X)

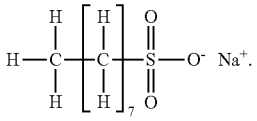

The present invention is also directed to a cleaning solution comprising, consisting essentially of, and/or consisting of: (a) a primary solvent, wherein the primary solvent comprises water; (b) a secondary solvent, wherein the secondary solvent is selected from the group consisting of a terpene, a cyclic terpene, orange oil, limonene, and d-limonene; (c) an oxidizing agent, wherein the oxidizing agent comprises hydrogen peroxide; (d) a hybrid surfactant system, wherein the hybrid surfactant system comprises: (1) a nonionic surfactant comprising an ethoxylated alcohol; (2) a first anionic surfactant comprising an alkyl benzene sulfonate; and (3) a second anionic surfactant comprising an alkyl sulfonate; and (e) an antioxidant, wherein the antioxidant comprises the structure of formula III:

(III)

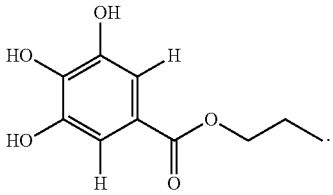

The present invention is further directed to a cleaning solution comprising, consisting essentially of, and/or consisting of: (a) a primary solvent, wherein the primary solvent comprises water; (b) a secondary solvent, wherein the secondary solvent is selected from the group consisting of a terpene, a cyclic terpene, orange oil, limonene, and d-limonene; (c) an oxidizing agent, wherein the oxidizing agent comprises hydrogen peroxide; (d) a hybrid surfactant system, wherein the hybrid surfactant system comprises: (1) a nonionic surfactant comprising an ethoxylated alcohol; (2) a first anionic surfactant comprising an alkyl benzene sulfonate; and (3) a second anionic surfactant comprising an alkyl sulfonate; (e) an antioxidant, wherein the antioxidant comprises the structure of formula II:

(II)

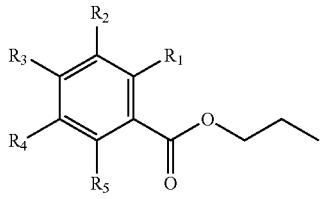

wherein three of $R_1$-$R_5$ comprise OH; and (f) wherein any remainder comprises adjunct agents.

DETAILED DESCRIPTION OF THE INVENTION

While this invention is susceptible of embodiment in many different forms, there is shown in the structural formulas and described herein in detail several specific embodiments with the understanding that the present disclosure is to be considered as an exemplification of the principles of the invention and is not intended to limit the invention to the embodiments illustrated. It will be understood that the structural formulas disclosed herein are intended to comprise all stereochemcial configurations regardless of graphical representations.

In accordance with the present invention, peroxide based cleaning, degreasing, and sanitizing/virucidal solutions are disclosed herein that are effective, exhibit environmentally preferred characteristics for industrial, commercial, and/or residential applications, and satisfy color, odor, and/or shelf life expectations of the customer.

In one embodiment of the present invention, the cleaning solution comprises: a primary solvent, a secondary solvent, an oxidizing agent, one or more surfactants, and an antioxidant.

For purposes of the present disclosure, the primary solvent of the solution may comprise one or more of any one of a number of common, commercially available solvents, including polar solvents and/or non-polar solvents. Specific examples of preferred solvents include, for example, water, hexane, acetone, methyl ethyl ketone, toluene, benzene, ethers, 3-methylsulfolane, glutaronitrile, dimethyl sulfoxide, dimethyl formamide, acetonitrile, polyethers including tetraglyme, alcohols including ethoxyethanol, nitriles including 3-hydroxypropionitrile, 2-methylglutaronitrile, ketones including 2-acetylbutyrolactone, cyclopentanone, cyclic esters including beta-propiolactone, gam ma-butyrolactone, gam ma-valerolactone, propylene carbonate, ethylene carbonate and homogenous mixtures of the same. While specific solvents have been disclosed, for illustrative purposes only, as being suitable primary solvents, numerous other solvents that would be known to those having ordinary skill in the art having the present disclosure before them are likewise contemplated for use. Indeed, it will be understood that non-liquid or polymer type media are suitable for use in accordance with the present invention. Preferably, the primary solvent is present in a concentration ranging from approximately 60 percent by weight to approximately 99.9 percent by weight, and more preferably from approximately 75 percent by weight to approximately 85 percent by weight.

In accordance with the present invention, the cleaning solution includes a secondary solvent. Suitable examples of secondary solvents include terpene, a cyclic terpene, orange oil, limonene, and/or d-limonene. Preferably, the secondary solvent is present in a concentration ranging from approximately 0.005 percent by weight to approximately 10 percent by weight, and more preferably from approximately 1 percent by weight to approximately 5 percent by weight.

In one embodiment of the present invention, the oxidizing agent comprises a peroxide, such an inorganic peroxide (e.g., hydrogen peroxide) and/or an organic peroxide. Other examples of oxidizing agents include electron accepting compounds, nitric acid, sulfuric acid, hydrochloric acid, peroxydisulfuric acid, hydrochloric acid, and peroxymonosulfuric acid. Preferably, the oxidizing agent is present in a concentration ranging from approximately 0.005 percent by weight to approximately 25 percent by weight, and more preferably from approximately 3 percent by weight to approximately 20 percent by weight.

For purposes of the present disclosure, the antioxidant comprises 6-Hydroxy-2,5,7,8-tetramethylchroman-2-carboxylic acid and/or the structure of formula I:

(I)

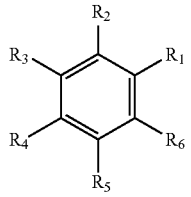

wherein $R_1$-$R_6$, are each independently selected from the group consisting of H; OH; and an alkyl, cycloalkyl, polycycloalkyl, heterocycloalkyl, aryl, alkaryl, aralkyl, alkoxy, alkanoyl, aroyl, alkenyl, alkyl-alkenyl, alcohol, ether, ketone, carboxylic acid, acid halide, acid anhydride, ester, and/or amide group containing approximately 1 to approximately 25 carbon atom(s); wherein at least three of $R_1$-$R_6$ comprise OH; and wherein at least one of $R_1$-$R_6$ comprises an ester. More preferably, $R_2$-$R_4$ each comprise OH and $R_6$ comprises an ester group containing approximately 3 to approximately 7 carbon atom(s).

In a preferred embodiment of the present invention, the antioxidant comprises the structure of formula II:

(II)

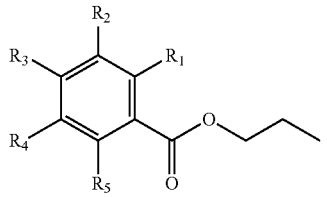

wherein three of $R_1$-$R_5$ comprise OH. One specific example of a suitable antioxidant comprises the structure of formula III:

(III)

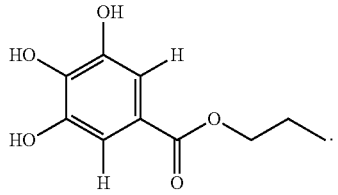

Preferably, the antioxidant is present in a concentration ranging from approximately 0.0001 percent by weight to approximately 5 percent by weight, and more preferably from approximately 0.01 percent by weight to approximately 2 percent by weight.

For purposes of the present disclosure the cleaning solution comprises a surfactant system that preferably comprises: (1) a nonionic surfactant, (2) a first anionic surfactant, and (3) a second anionic surfactant.

Preferred nonionic surfactants include those represented by the structure of formula IV:

$$R_1O(CH_2CH_2O)_nH \quad \text{(IV)}$$

wherein $R_1$ comprises a hydrophobic portion of the nonionic surfactant obtained from a linear alcohol having carbon lengths ranging from approximately 12 to approximately 15; and wherein n comprises an integer ranging from approximately 7 to approximately 10, and wherein n represents the average moles of ethylene oxide per mole of alcohol. Preferred examples of nonionic surfactants include ethoxylated alcohols. Preferably, the nonionic surfactant is present in a concentration ranging from approximately 0.01 percent by weight to approximately 5 percent by weight, and more preferably from approximately 0.5 percent by weight to approximately 2 percent by weight.

In a preferred embodiment of the present invention, the first anionic surfactant comprises a sulfonate, including, but not limited to, alkyl benzene sulfonate. Other suitable first anionic surfactants comprise the structure of formula V:

(V)

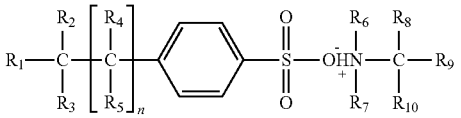

wherein $R_1$-$R_{10}$, are each independently selected from the group consisting of H; OH; and an alkyl, cycloalkyl, polycycloalkyl, heterocycloalkyl, aryl, alkaryl, aralkyl, alkoxy, alkanoyl, aroyl, alkenyl, alkyl-alkenyl, alcohol, ether, ketone, carboxylic acid, acid halide, acid anhydride, ester, and/or amide group containing approximately 1 to approximately 25 carbon atom(s); and wherein n comprises an integer ranging from approximately 5 to approximately 15.

More preferably, the first anionic surfactant comprises the structure of formula VI:

(VI)

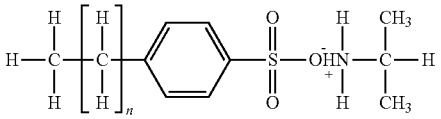

wherein n comprises an integer ranging from approximately 5 to approximately 15. One specific example of a first anionic surfactant comprises the structure of formula VII:

(VII)

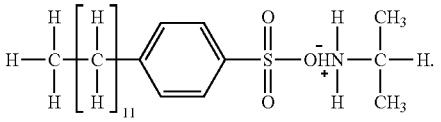

Preferably, the first anionic surfactant is present in a concentration ranging from approximately 0.01 percent by weight to approximately 5.0 percent by weight, and more preferably from approximately 1.0 percent by weight to approximately 2.0 percent by weight.

For purposes of the present disclosure, the second anionic surfactant preferably comprises a sulfonate, such as, but not limited to, an alkyl sulfonate. Preferably, the second anionic surfactant comprises the structure of formula VIII:

(VIII)

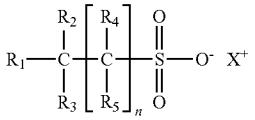

wherein $R_1$-$R_5$, are each independently selected from the group consisting of H; OH; and an alkyl, cycloalkyl, polycycloalkyl, heterocycloalkyl, aryl, alkaryl, aralkyl, alkoxy, alkanoyl, aroyl, alkenyl, alkyl-alkenyl, alcohol, ether, ketone, carboxylic acid, acid halide, acid anhydride, ester, and/or amide group containing approximately 1 to approximately 25 carbon atom(s); wherein n comprises an integer ranging from approximately 2 to approximately 15; and wherein X comprises an alkali metal ion. More preferably, the second anionic surfactant comprises the structure of formula IX:

(IX)

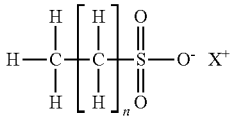

wherein n comprises an integer ranging from approximately 2 to approximately 15; and wherein X comprises an alkali metal ion. One specific example of the second anionic surfactant comprises the structure of formula X:

(X)

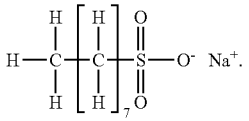

Preferably, the second anionic surfactant is present in a concentration ranging from approximately 0.5 percent by weight to approximately 5.0 percent by weight, and more preferably from approximately 1.0 percent by weight to approximately 2.0 percent by weight.

It will be further understood that any reference to compounds disclosed herein includes salts and/or solvates of the same.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A cleaning solution, consisting of:

a primary solvent, wherein the primary solvent consists of water;

a secondary solvent, wherein the secondary solvent is selected from the group consisting of a terpene, a cyclic terpene, orange oil, limonene, and d-limonene;

an oxidizing agent, wherein the oxidizing agent consists of hydrogen peroxide;

a hybrid surfactant system, wherein the hybrid surfactant system consists of a nonionic surfactant consisting of an ethoxylated alcohol, a first anionic surfactant consisting of an alkyl benzene sulfonate, and a second anionic surfactant consisting of an alkyl sulfonate; and an antioxidant, wherein the antioxidant consists of the structure of formula II:

(II)

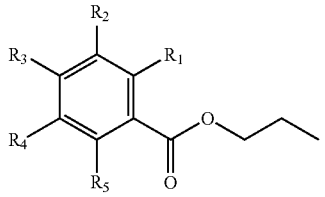

wherein three of $R_1$-$R_5$ are OH.

2. A cleaning solution, consisting of:

a primary solvent present in a concentration ranging from 75 percent to 85 percent by weight, wherein the primary solvent consists of water;

a secondary solvent present in a concentration ranging from 1 percent to 5 percent by weight, wherein the secondary solvent is selected from the group consisting of a terpene, a cyclic terpene, orange oil, limonene, and d-limonene;

an oxidizing agent present in a concentration ranging from 3 percent to 20 percent by weight, wherein the oxidizing agent consists of hydrogen peroxide;

a hybrid surfactant system, wherein the hybrid surfactant system consists of a nonionic surfactant consisting of an ethoxylated alcohol present in a concentration ranging from 0.5 percent to 2 percent by weight, a first anionic surfactant consisting of an alkyl benzene sulfonate present in a concentration ranging from 1 percent to 2 percent by weight, and a second anionic surfactant consisting of an alkyl sulfonate present in a concentration ranging from 1 percent to 2 percent by weight; and an antioxidant present in a concentration ranging from 0.01 percent to 2 percent by weight, wherein the antioxidant consists of the structure of formula II:

(II)

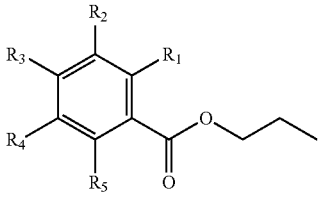

wherein three of $R_1$-$R_5$ are OH.

* * * * *